US010844693B2

(12) United States Patent
Douglas et al.

(10) Patent No.: US 10,844,693 B2
(45) Date of Patent: Nov. 24, 2020

(54) PRESSURE MANAGEMENT SYSTEM FOR A WELL ANNULUS

(71) Applicants: Benjamin B. Douglas, Ashwood (AU); Ian McKay, Gardenvale (AU); Malcom J. Stevenson, Mt Eliza (AU)

(72) Inventors: Benjamin B. Douglas, Ashwood (AU); Ian McKay, Gardenvale (AU); Malcom J. Stevenson, Mt Eliza (AU)

(73) Assignee: ExxonMobil Upstream Research Company, Spring, TX (US)

( * ) Notice: Subject to any disclaimer, the term of this patent is extended or adjusted under 35 U.S.C. 154(b) by 99 days.

(21) Appl. No.: 16/138,474

(22) Filed: Sep. 21, 2018

(65) Prior Publication Data

US 2019/0153821 A1 May 23, 2019

Related U.S. Application Data

(60) Provisional application No. 62/589,907, filed on Nov. 22, 2017.

(51) Int. Cl.

| | |
|---|---|
| ***E21B 21/08*** | (2006.01) |
| ***E21B 47/06*** | (2012.01) |
| ***E21B 34/16*** | (2006.01) |
| ***E21B 43/16*** | (2006.01) |
| ***E21B 41/00*** | (2006.01) |
| ***E21B 43/12*** | (2006.01) |

(52) U.S. Cl.
CPC ..... *E21B 41/00* (2013.01); *E21B 43/12* (2013.01)

(58) Field of Classification Search
CPC ..... E21B 21/08; E21B 47/06; E21B 34/16; E21B 43/18; E21B 43/166; E21B 43/168; E21B 21/082; E21B 21/085
See application file for complete search history.

(56) References Cited

U.S. PATENT DOCUMENTS

| | | | | |
|---|---|---|---|---|
| 8,596,294 | B2 * | 12/2013 | Otanez | F15B 1/027 137/455 |
| 9,611,718 | B1 * | 4/2017 | Bond | E21B 34/00 |
| 2017/0167224 | A1 * | 6/2017 | Holder | E21B 34/108 |

* cited by examiner

*Primary Examiner* — Catherine Loikith
(74) *Attorney, Agent, or Firm* — ExxonMobil Upstream Research Company

(57) ABSTRACT

A system and methods for maintaining pressure on an annulus in a well are provided. An example of a pressure maintenance system for an annulus on a well, included a passive accumulator coupled to the annulus to accept fluid expanding in the annulus or to supply fluid to replace fluid contracting in the annulus. A gas pressure system is included to maintain a gas in a headspace over the fluid in the passive accumulator, and a pressure controller maintains pressure in the headspace within a set range.

24 Claims, 11 Drawing Sheets

100

200

300

400

500

410

700

800

900

1000

1100

PRESSURE MANAGEMENT SYSTEM FOR A WELL ANNULUS

CROSS REFERENCE TO RELATED APPLICATION

This application claims the benefit of U.S. Provisional Application Ser. No. 62/589,907, filed Nov. 22, 2017, the disclosure of which is incorporated herein by reference in its entirety.

FIELD

The techniques described herein provide a method for managing pressure in a well annulus. More specifically, the techniques address the use of a system to allow fluids to expand in and out of an annulus while maintaining pressure in a set range.

BACKGROUND

This section is intended to introduce various aspects of the art, which may be associated with exemplary embodiments of the present techniques. This description is believed to assist in providing a framework to facilitate a better understanding of particular aspects of the present techniques. Accordingly, it should be understood that this section should be read in this light, and not necessarily as admissions of prior art.

Hydrocarbon production may take place in any number of environments. Wells may be drilled in mountain environments, subsea environments, and other challenging locations. The drilling may start with a relatively large diameter section, for example, 12 cm (centimeters) to 1 m (meters) in width. At a certain depth, depending on the subsurface formation being drilled, the drill is pulled out of the wellbore (termed "tripped out" herein), and steel tubular sections of a diameter slightly less than the wellbore are inserted. These steel tubular sections (termed "casing" herein), are used to provide structural integrity to the wellbore and isolate zones in the subsurface formation from each other and the surface. In many cases, the area around the outside of the casing is filled with cement to provide further reinforcement and isolation.

After the initial casing is completed, drilling is resumed with a slightly smaller diameter bit. The drilling at the new diameter is continued until it is determined that another length of casing needs to be inserted. Accordingly, the drill string is tripped out of the wellbore and more sections of casing, having a smaller diameter than the initial casing sections, are inserted. The drilling and casing operations are continued until the wellbore reaches the production zone of the formation. The string of casing passing through the production zone may be termed the production string. The production string is then perforated to allow fluids to flow into it.

As the wells are placed into service, fluids from the formation are brought to the surface, or produced, through the production string. These fluids may be at elevated temperatures due to geothermal gradients. Over time, fluids in outer annuli are heated by the production fluids and expand. The expansion increases the pressure in these annuli, which may be released from bleeder valves at the surface. However, if this is not released then the excess pressure may cause rupture or collapse of adjacent casing strings. Also, after a well is shut in, or temporarily closed off from production, the casing at higher levels in the well drops in temperature. This lowers the pressure in the casing, which may pull lower density fluids in from formations exposed below the casing. Repeated thermal cycling can then progressively reduce the fluid density within the casing, increasing the pressure at the top of the casing string, potentially causing collapse or rupture at the top of the string.

SUMMARY

An example described herein provide a pressure maintenance system for an annulus on a well, including a passive accumulator coupled to the annulus to accept fluid expanding in the annulus or supply fluid to replace fluid contracting in the annulus. A gas pressure system is included to maintain a gas in a headspace over the fluid in the passive accumulator, and a pressure controller maintains pressure in the headspace within a set range.

The gas pressure system may include a nitrogen plant, for example, including a nitrogen membrane system or a pressure swing absorption system. The gas pressure system may include gas storage tanks.

The pressure controller may include a gas feed valve coupled to a gas storage system. The pressure controller may include a vent valve coupled to the headspace of the passive accumulator. A pressure sensor may be used to monitor the pressure in the headspace.

The passive accumulator may include a group of interconnected vessels. A level indicator may be included to determine a level of fluid in the passive accumulator. A liquid addition system may be used to add liquid to the passive accumulator.

Another example described herein provides a method for maintaining a pressure on an annulus of a well. The method includes coupling a passive accumulator in a pressure maintenance system to the annulus of the well while the well is blocked in and cool. A fluid is added to the passive accumulator to set a cold fluid level. Production from a production line in the well is started. Expanding fluid from the annulus is allowed to flow into the passive accumulator as the well needs. A pressure set point is maintained in the passive accumulator.

The method may include blocking in the production line and allowing fluid for the passive accumulator to flow into the annulus as the well cools, while maintaining the pressure set point in the passive accumulator. Maintaining the pressure set point in the passive accumulator may include venting gas from the passive accumulator as the fluid level in the passive accumulator increases. Maintaining the pressure set point in the passive accumulator may include adding gas to the passive accumulator as the fluid level in the passive accumulator decreases.

The method may include waiting until the fluid level in the passive accumulator stabilizes at a hot fluid level and replacing a portion of the fluid with a fresh fluid. The well may be blocked in to allow the annulus to cool and the fresh fluid to flow into the annulus.

The gas used for pressure maintenance may be produced at the wellsite. A nitrogen plant may be used to produce the gas for pressure maintenance.

A further example provides a method for maintaining a pressure on an annulus of a well. The method includes coupling a passive accumulator in a pressure maintenance system to the annulus of the well while the well is in production and hot. A fluid is added to the passive accumulator to set a hot fluid level. Production from a production line in the well is stopped and fluid from the passive accumulator is allowed to flow into the annulus is the well cools, while maintaining a pressure set point in the passive accumulator.

Further examples described herein provide a method for replacing a fluid in an annulus for well. The method may include coupling a passive accumulator in a pressure maintenance system to the annulus while the weather was cool, and adding fluid to the passive accumulator to seta cold fluid level. Well production may be started and expanding fluid from the annulus may be allowed to flow into the accumulator is the well heats. The fluid level in the accumulator is allowed to stabilize. A portion of the fluid in the accumulator is replaced and well production is stopped to allow the well to cool. The contracting fluid in the annulus is allowed to pull fluid from the accumulator as the well cools.

This method may include maintaining a pressure set point range on the accumulator is the fluid level changes. The temperature of the well may be cycled by starting and stopping production allowing a replacement of a portion of the fluid in the accumulator after the level stabilizes at each high temperature point, while maintaining the pressure set point range on the accumulator throughout the procedure. Additives may be incorporated into the fluid that is used to replace fluid in the passive accumulator.

DESCRIPTION OF THE DRAWINGS

The advantages of the present techniques are better understood by referring to the following detailed description and the attached drawings.

DETAILED DESCRIPTION

Figure 1:
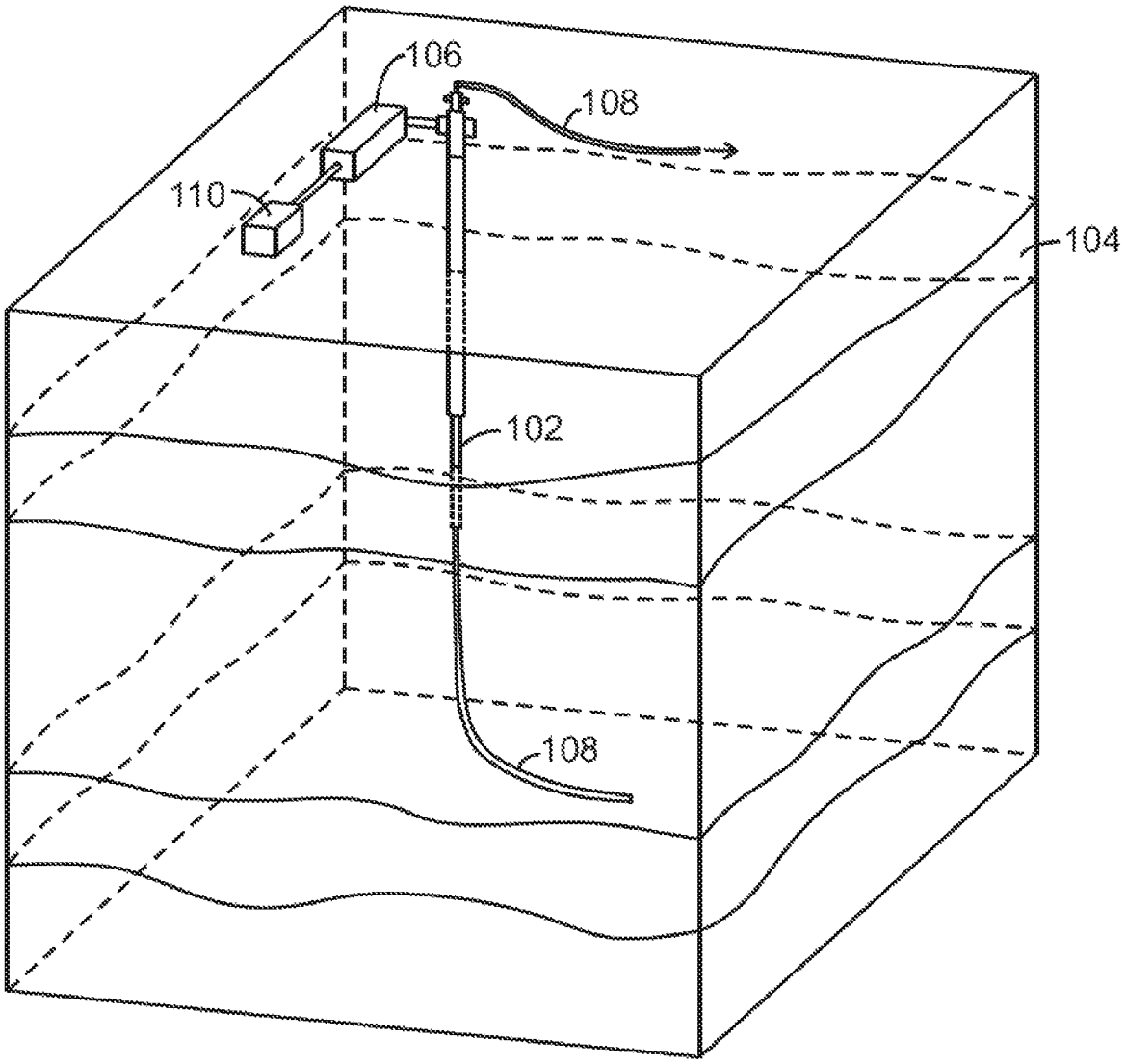
FIG. 1 is a schematic diagram of an example of a well in which cased sections of the well may terminate in a high-pressure zone.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

Formation pressure on some well annuli have approached the maximum allowable pressure that causes casing to collapse. However, the fluid pressure may not be easily reduced without causing an open lower section of the annulus to reduce below the formation pore pressure. Reducing below the pore pressure will enable production of pore water to the annulus reducing the fluid density and increasing the surface pressures on the casing. Thus, control of pressure in the annuli may lessen the risk of a casing collapse or other problems.

During operation of a well, an increase in annuli pressures may be caused by thermal expansion as the well moves from cold to hot during production. While manual bleeding of fluid from the annulus may lower the pressure, the manual bleeding may not be capable of maintaining pressures within an acceptable range as the well is cycled through production and blocked in phases. For example, during warm-up releasing fluid from the annulus through bleeding of annulus fluids will leave the annulus with less fluid than when it was cold. Once the well is shut down and cools, replacement of the fluid may be needed to maintain the required pressures without becoming underbalanced with the downhole pore pressures.

As used herein, cold indicates an equilibrium temperature reached in a well that has been blocked in or closed to production. The temperature may have a geothermal gradiant, for example, an increasing temperature from the top of the well to the bottom of the well. In contrast, hot indicates an equilibrium, or near equilibrium, temperature reached in a well that is in production. In this example, production fluids carry energy from lower, hotter regions of the well, increasing the temperature of higher regions of the well. The temperature of upper regions of the well may vary slightly, as the production rate may also have an influence on the temperature at equilibrium.

A system is disclosed herein to automatically enable fluid volumes to be removed from and returned to an annulus throughout all thermal cycles, while maintaining a pressure set point in a preset range. The system includes one or more passive accumulators that use a gas as a compressible compensating fluid to maintain pressure. During thermal expansion, fluid flows into the passive accumulator, increasing the level from a cold fluid level to a hot fluid level. As the level increases, gas may be vented from the accumulator to maintain a pressure set point.

When the well is blocked in and allowed to cool, the fluid in the passive accumulator returns to the annulus. Active pressure controls maintain the pressure set point on the passive accumulator by the addition of gas to the head space. A gas plant may be located near the well to provide the gas without a need for transportation. However, in some examples, the well may be located near a gas pipeline that may be used to provide the gas.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

"Hydrocarbons" refer to an organic compound that primarily includes the elements hydrogen and carbon, although nitrogen, sulfur, oxygen, metals, or any number of other elements may be present in small amounts. As used herein, hydrocarbons generally refer to components found in natural gas, oil, or chemical processing facilities.

A "reservoir" refers to a subsurface rock formation from which a production fluid can be harvested. The rock formation may include shale, granite, silica, carbonates, clays, and organic matter, such as oil, gas, or coal, among others.

"Substantial" when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

"Subterranean formation" or formation refers to the material existing below the Earth's surface. The formation may comprise a range of components, e.g. minerals such as quartz, siliceous materials such as sand and clays, as well as the oil and/or gas that is extracted. As used herein, formation may include a reservoir.

"Tubular construct" refers to tubing or a system of casing, tubes, tubulars, pipes, pipelines, flowlines, and the like used for holding or transporting any liquids and/or gases, and any incidental particulate matter or solids, from one location to another.

"Wellbore" refers to at least one wellbore drilled into a subterranean formation, which may be a reservoir or adjacent to a reservoir. A wellbore can have vertical and horizontal portions, and it can be straight, curved, or branched. As used herein, the term "wellbore" refers to a wellbore itself, including any uncased, open-hole portion of the wellbore. "Well" refers to a full wellbore including both cased and uncased sections.

FIG. 1 is a schematic diagram of an example of a well 100 in which cased sections 102 of the well 100 may terminate in a high-pressure zone 104. In this example, an annulus pressure maintenance system (APMS) 106 may be used to maintain a pressure set point within a range for an annulus in the well 100. As used herein, an annulus is a space between an outer casing and an inner casing or the production line 108. This is discussed further with respect to FIG. 2. The APMS 106 is not limited to protecting a single annulus, but may include equipment to protect multiple annuli in the well 100. The APMS 106 may be provided nitrogen from a nitrogen supply system 110. The nitrogen supply system one then may include a nitrogen plant and nitrogen storage tanks.

Figure 2:
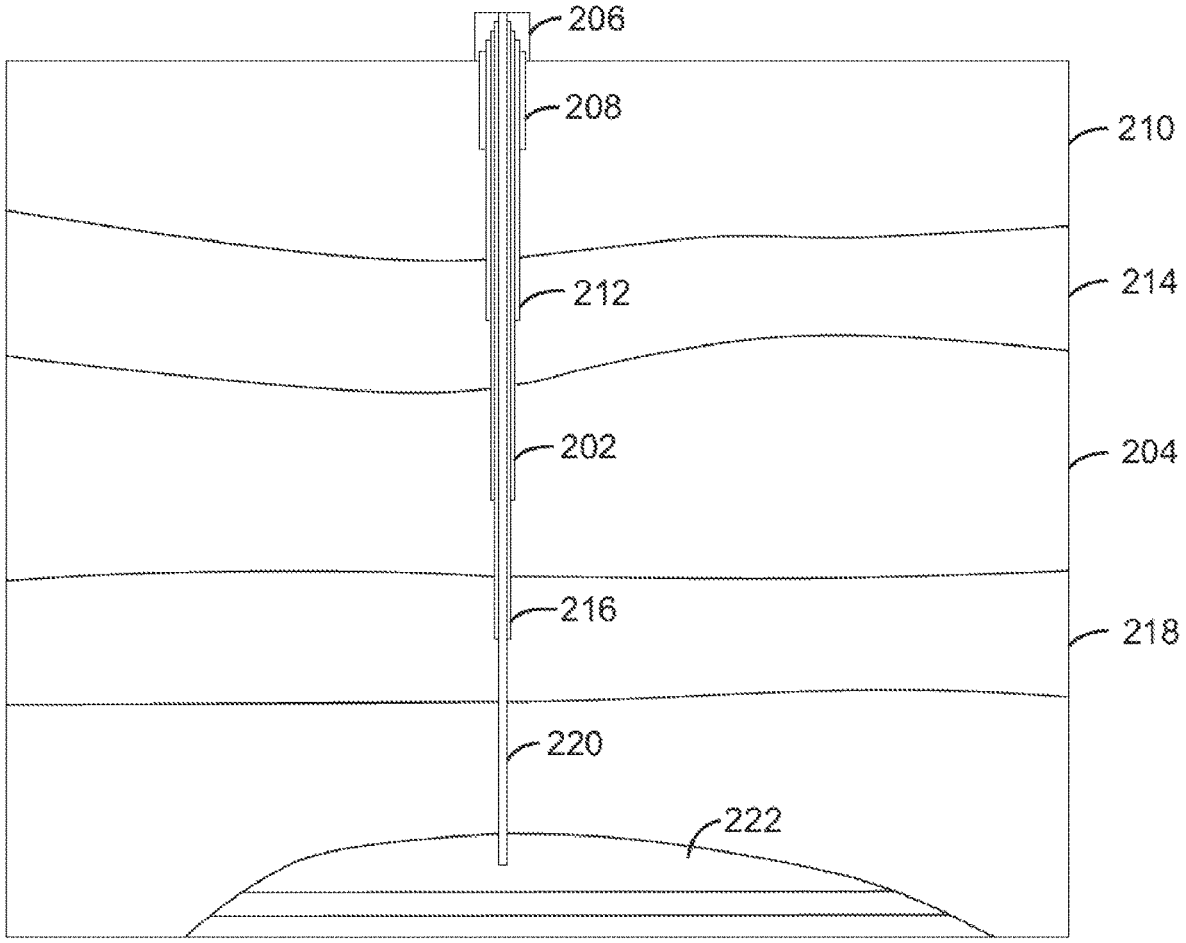
FIG. 2 is a cross-sectional view of another example of a well in which a cased section of the well may terminate in a high-pressure zone.

FIG. 2 is a cross-sectional view of another example of a well 200 in which a cased section 202 of the well 200 may terminate in a high-pressure zone 204. The well 200 may include surface equipment 206, indicated as a box in FIG. 2 to simplify the diagram. The well 200 may also include other cased sections, such as an initial cased section 208 ending in a first subsurface formation 210, a second cased section 212, ending in a second subsurface formation 214, and a final cased section 216 ending in another subsurface formation 218. A production line 220 may then extend from the final section of casing 216 to a reservoir 222.

As described herein, as materials from the reservoir 222 flow through the production line 220, geothermal heating may cause expansion of materials in the annuli created by each of the casing segments 202, 208, 212, and 216. The expansion of the materials in the annuli raises the pressure and may cause damage to the casing segments 202, 208, 212, and 216. Pressure sensors may be used to indicate when the pressure is climbing to problematic levels, for example, to allow an operator to bleed off fluid, lowering the pressure.

However, when production from the well 200 is subsequently stopped, or blocked in, the material in the annuli will cool and contract, lowering the pressure. The decrease in pressure may be problematic. For example, the lower pressure may allow material from a formation, such as high-pressure zone 204, to enter the annulus through the opening at the casing joint between the casing segment 202 and casing segment 216. In one example, the high-pressure zone 204 may be an over-pressured shale that is above a lithostatic gradient. In this example the high-pressure zone 204 may be at several thousand kilopascals (kPa).

In some formations, the removal of liquids, such as aquifer water, from the formation may lead to a dilution of fluids in the annulus. As the fluids in the annulus are diluted, the weight of the fluids in the annulus may decrease, leading to an increase in in pressure at the surface, at the formation, or both. Through multiple cycles of startup and shutdown, this increase in pressure may approach levels that destabilize the casing segment 202 in the high-pressure zone 204, or at the surface, or both.

Accordingly, an APMS, as described herein, may be used to maintain pressure on an annulus. This may be performed by maintaining the pressure of a fluid in the annulus. The APMS may be used for surface well, as described with respect to FIG. 1, or may be used for a subsea well, as described with respect to FIG. 3

Figure 3:
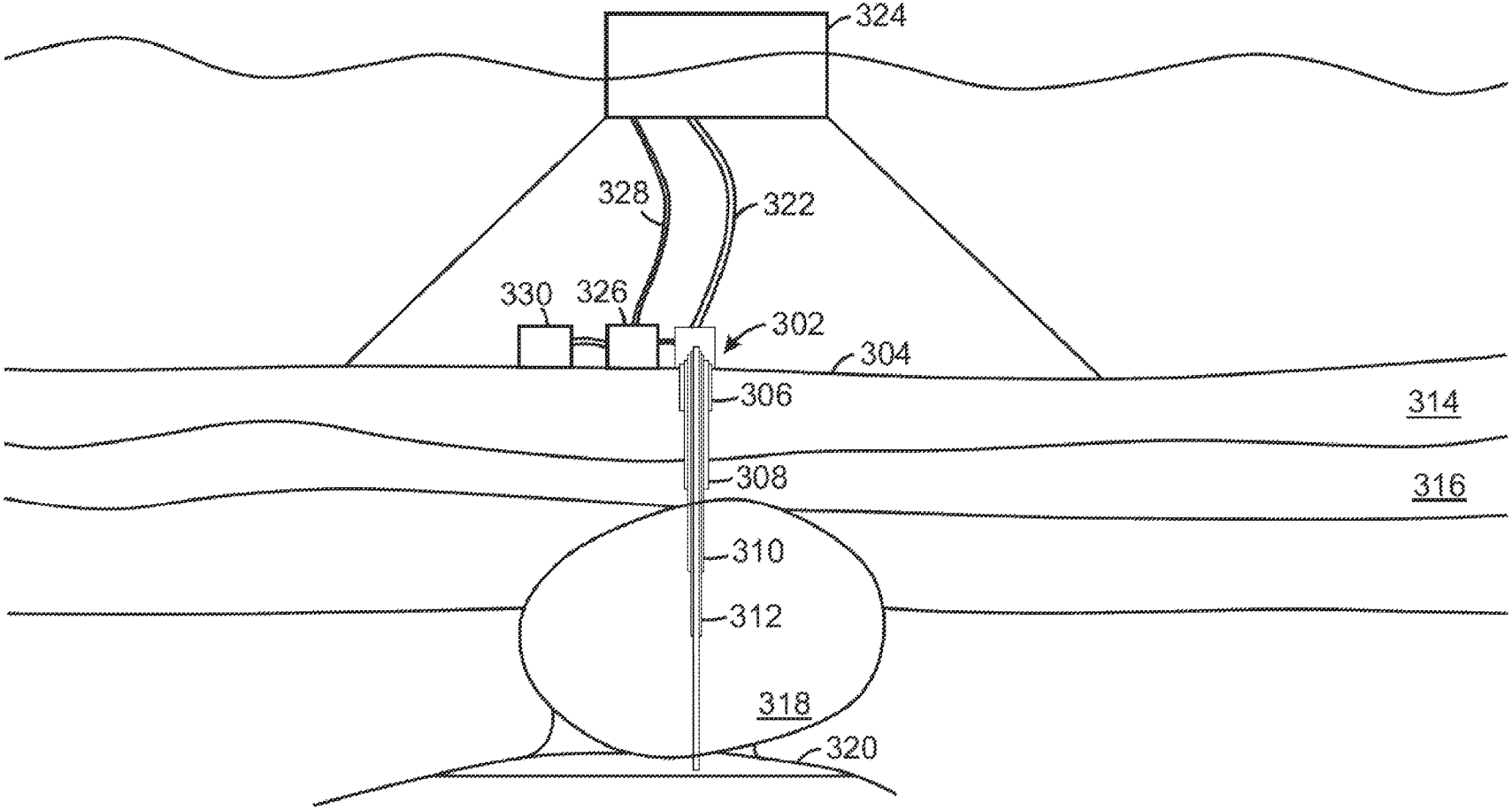
FIG. 3 is a schematic diagram of an example of a well on a seafloor in which cased sections of the well may terminate in high-pressure zones.

FIG. 3 is a schematic diagram of an exemplary system 300 of a well 302 on a seafloor 304 in which cased sections 306, 308, 310, and 312, of the well 302 may terminate in high-pressure zones 314 or 316. In this example 300, the well 302 is drilled through a salt dome 318 to reach the reservoir 320. A production line 322 from a surface vessel 324 may carry hydrocarbons from the well 302 to the surface vessel 324.

An APMS 326 may be used to maintain pressure on one or more annuli in the well 302. A gas umbilical 328 may include a line to carry gas from a gas plant in the surface vessel 324 to the APMS 326. A gas storage system 330 may be used to store high-pressure gas at the seafloor for use by the APMS 326. A second line in the gas umbilical 328 may carry vent gas from the APMS 326 back to the surface vessel 324. The gas may be nitrogen produced in a gas plant at the surface vessel 324. In some examples, the gas may be natural gas that is isolated from the well 302 prior to sending liquid hydrocarbons to the surface vessel 324 through the production line 322.

Figure 4:
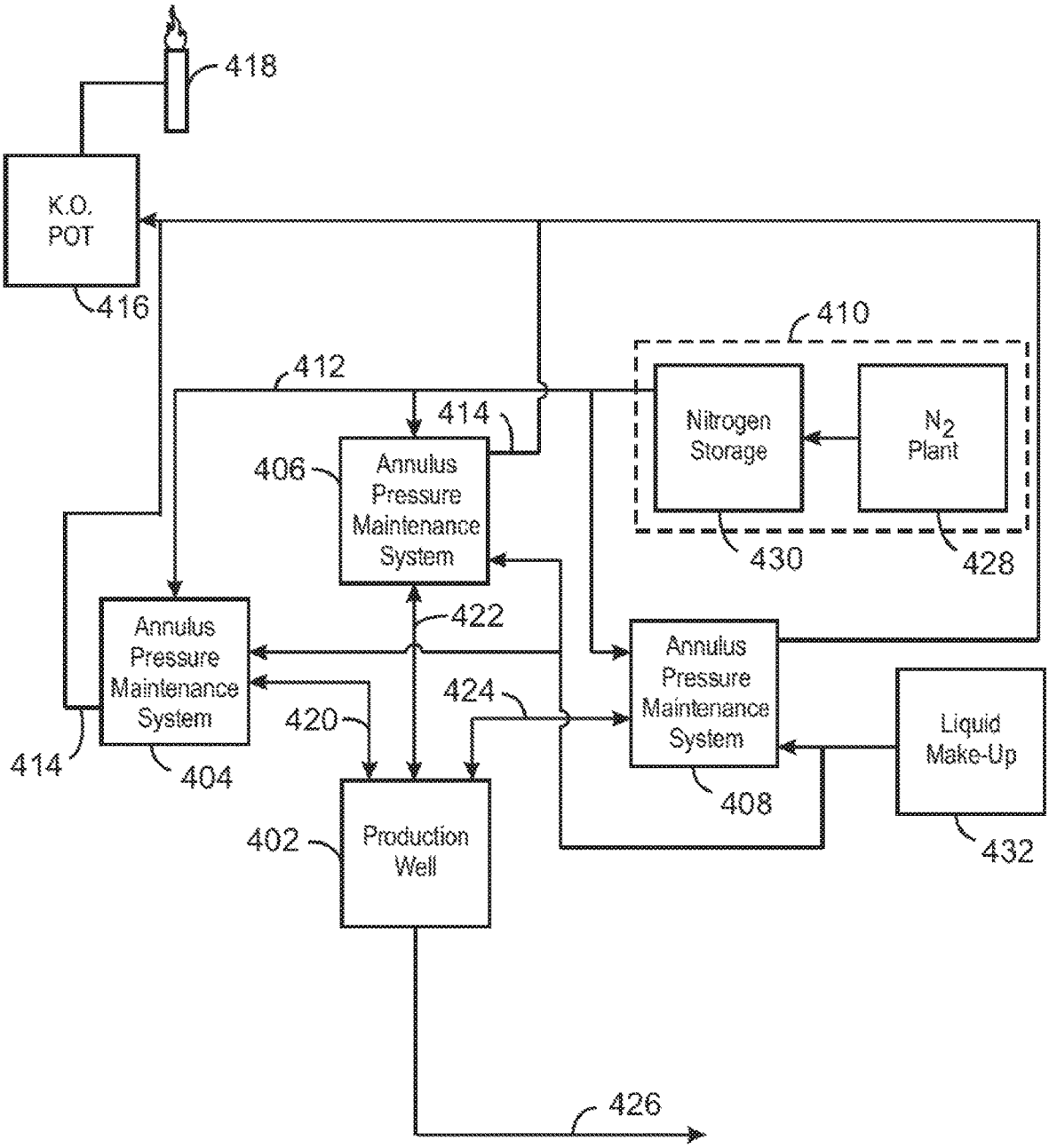
FIG. 4 is a block diagram of an example of a system for maintaining pressure in annuli of a well.

FIG. 4 is a block diagram of an example of a system 400 for maintaining pressure in annuli of a well 402. In this example, the system 400 may be used to maintain the pressure in three annuli of the well 402. To perform this function, the system 400 includes three APMS 404, 406, and 408.

Each APMS 404, 406, or 408 is coupled to a nitrogen generation and storage system 410 to provide nitrogen for positive pressure changes through a nitrogen line 412. A vent line 414 on each APMS 404, 406, and 408, may be used to release gas from the APMS for negative pressure changes. The vent line 414 may be coupled to a knockout pot 416 to capture any liquids released from the APMS 404, 406, or 408. The knockout pot 416 may feed a flare or vent 418 to burn off hydrocarbons that may be released from the APMS 404, 406, or 408.

Each APMS 404, 406, or 408, may be coupled to an annulus through a liquid line 420, 422, or 424, respectively. For example, if the well 402 has five annuli, three of which open into high-pressure zones, the APMS 404, 406, and 408, may be used to maintain a pressure set point for these three annuli. As described herein, as fluid 426 is produced from the well 402, the annuli heat up causing expansion of fluid. The fluid flows from the annuli through the liquid lines 420, 422, and 424, into the APMS 404, 406, and 408. When production is halted, for example, by blocking in the well 402, the fluid in the annuli contracts, and the fluid in the APMS 404, 406, and 408 is pushed back into the annuli.

Figure 6:
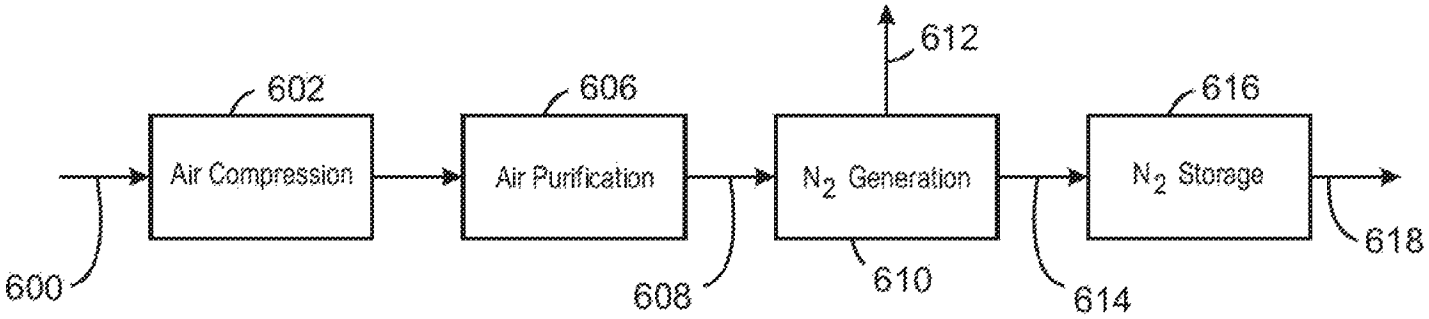
FIG. 6 is a block diagram of an example of a nitrogen generation and storage system (NGSS) that may be used to generate nitrogen for an APMS.

The nitrogen generation and storage system 410 may include a nitrogen plant 428, as described further with respect to FIG. 6, and a nitrogen storage system 430. The APMS 404, 406, and 408 are not limited to nitrogen as other gases may be used to provide the positive pressure. For example, the well 402 may be in a field that has a high natural gas content, which may not be marketable. The natural gas may be pressurized and return to the reservoir to maintain reservoir pressure. In this example, a portion of the pressurized natural gas may be used to maintain pressure in the APMS 404, 406, and 408. The vented natural gas may be returned to the feed of the compressors. Other gases may also be used, such as carbon dioxide obtained from wells with a high carbon dioxide content, or from a carbon dioxide pipeline near the well 402.

A liquid makeup system 432 may be used to provide fluid to the APMS 404, 406, or 408. This may also be used, for example, to provide fluid for an initial startup, or to exchange fluid in the APMS and, thus, replace fluid in the annuli.

Figure 5:
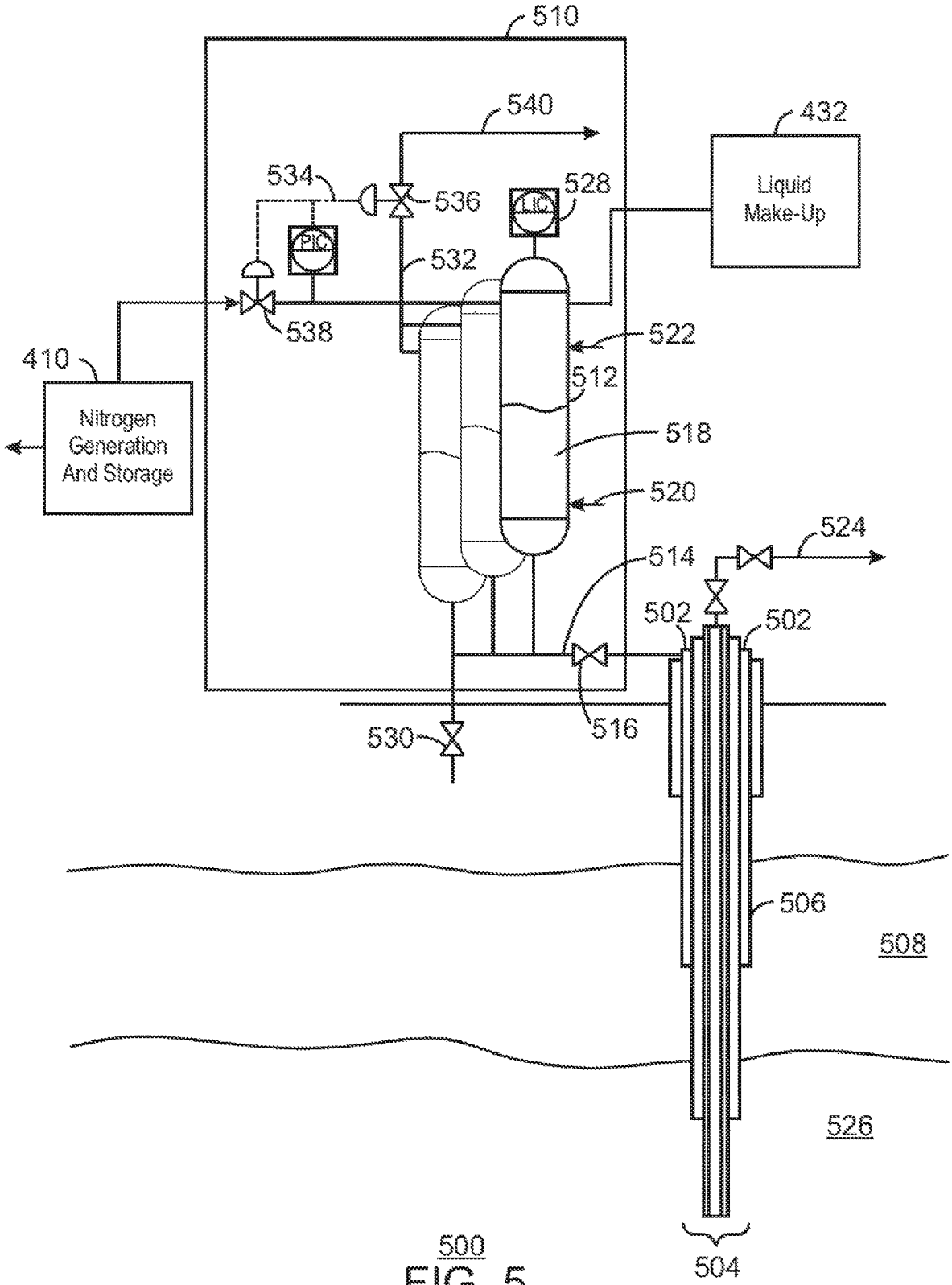
FIG. 5 is a simplified process flow diagram of an example of a system for maintaining pressure in an annulus of a well.

FIG. 5 is a simplified process flow diagram of an example of a system 500 for maintaining pressure in an annulus 502 of a well 504. In this example, the annulus 502 is formed by casing 506 that ends in a high-pressure zone 508 of a subsurface formation. The system 500 includes an APMS 510 and a nitrogen generation and storage system 410.

The APMS 510 includes one or more passive accumulators 512 coupled to the annulus 502 through a liquid line 514. Multiple passive accumulators 512 may be used to allow the size of each individual passive accumulator 512 to be decreased, making transport to a remote site more feasible. This may also be useful for subsea applications, in which the sidewalls of the passive accumulators 512 may be thick to withstand the pressure at the seafloor. The liquid line 514 may be coupled to a bleeder valve 516 on the annulus 502, for example, allowing the APMS 510 to be coupled to the annulus 502 while the well 504 is in operation.

The passive accumulators 512 may include a fluid 518. As the temperature changes in the annulus 502, the level of the fluid 518 may move between a cold fluid level 520, such as at about 20% of the volume of the passive accumulators 512, and a hot fluid level 522, such as at about 80% of the volume of the passive accumulators 512. The cold fluid level 520 may be present when the production line 524 on the well 504 is not producing, or blocked in, after the well 504 and the annulus 502 have cooled to an equilibrium temperature. The hot fluid level 522 may be present when the production line 524 is open, allowing fluid from the reservoir 526 to be produced, heating the well 504 and the annulus 502. In some examples, the hot fluid level 522 may include about 2400 liters (about 15 barrels) of fluid than the cold fluid level 520.

The level of the fluid in the passive accumulators 512 may be measured by a level controller 528. If the level of the fluid 518 falls below the cold fluid level 520, a liquid makeup system 432, as described with respect to FIG. 4, may be used to add fluid. In some examples, a bleeder valve 530 may be used to release some of the fluid 518 from the passive accumulators 512, for example, while the level of the fluid 518 is at the hot fluid level 522. The liquid makeup 432 may then be used to add additional fluid 518. This procedure may be used to replace at least a portion of the fluid 518, allowing fresh fluid 518 to be pulled back into the annulus 502 when the well 504 cools. This is described further with respect to FIG. 11.

A pressure maintenance line 532 may be coupled to the headspace of each of the passive accumulators 512. The pressure in the passive accumulators 512 may be controlled by a pressure controller 534 that controls a vent valve 536 and a gas valve 538. The vent valve 536 and the gas valve 538 may be diaphragm motor valves (DMVs), or other types of control valves that allow a proportional or incremental response to an actuation signal. In some examples, piston motor valves (PMVs) may be used instead of, or in addition to, the PMVs.

The vent valve 536 may allow the release of gas from the headspace of the passive accumulators 512 to a vent line 540, which may be coupled to a knockout pot 416, as described with respect to FIG. 4. This may occur as the level of the fluid 518 in the passive accumulators 512 increases. This may occur as the annulus 502 heats up, forcing expanding fluid 518 out of the annulus 502 through the liquid line 514 and into the passive accumulators 512.

The gas valve 538 may allow gas to flow into the headspace of the passive accumulators 512, such as from the nitrogen generation and storage system 410. This may occur as level of fluid 518 and the passive accumulators 512 decreases, for example, as the annulus 502 cools down and the fluid in the annulus 502 contracts. The pressure on the passive accumulators 512 may then force fluid 518 back into the annulus 502, maintaining the pressure of the fluid 518 in the annulus 502. In an example, the pressure set point may be at about 13,000 kPa (about 1900 psi) with a range of about ±170 kPa (about ±25 psi).

FIG. 6 is a block diagram of an example of a nitrogen generation and storage system (NGSS) 410 that may be used to generate nitrogen for an APMS. As described herein, the APMS is not limited to the use of nitrogen, but may use other gases, such as natural gas or carbon dioxide produced from the field or obtained from a pipeline. In this example, the NGSS 410 may be positioned proximate to the field, lowering transportation costs for the gas.

The NGSS 410 may include an air or other mixed gas composition input stream 600 compression system 602, which may be driven by a turbine engine powered by natural gas from the field. The compressed gas 604 from the air compression system 602 may be treated in an air purification system 606. The air purification system 606 may remove particulates, hydrocarbons, water vapor, and the like. In some examples, the air purification system 606 may remove carbon dioxide prior to the nitrogen generation.

The purified air 608 may be used as a feed to a nitrogen generation system 610. In the nitrogen generation system 610, other gases 612, such as oxygen, carbon dioxide, water vapor, and the like, may be rejected, providing a nitrogen enhanced stream 614. The nitrogen enhanced stream 614 may include about 90% nitrogen, about 95% nitrogen, about 99% nitrogen, or a higher concentration of nitrogen. The purity of the nitrogen enhanced stream 614 may depend on the technology selected for the nitrogen generation system 610, as described with respect to FIGS. 7 and 8. This may be based on system cost and the fluid used for pressure maintenance in the annulus. Fluids that are likely to contain higher amounts of hydrocarbons may militate towards the selection of technologies that provide higher purity for the nitrogen enhanced stream 614.

The nitrogen enhanced stream 614 may then be stored in a nitrogen storage system 616. The nitrogen storage system 616 may include one or more nitrogen gas tanks, which may provide nitrogen to an APMS during power outages, maintenance events, and the like. For example, the nitrogen storage system 616 may store sufficient nitrogen to provide pressure control during one or more start up and shut down procedures. This may increase the reliability of the APMS, lowering the risk that a power failure or equipment failure may damage the well. From the nitrogen storage system 616, a nitrogen stream 618 may be provided to an APMS.

Figure 7:
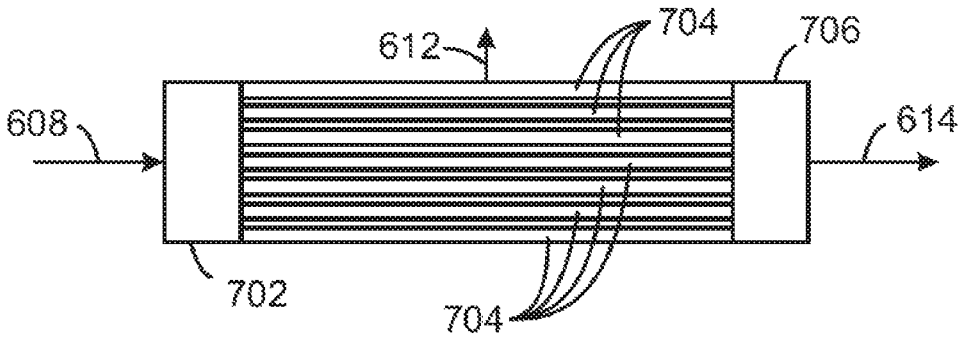
FIG. 7 is a schematic diagram of an example of a membrane system for generating a nitrogen enhanced stream in the NGSS.

FIG. 7 is a schematic diagram of an example of a membrane system 700 for generating a nitrogen enhanced stream 614 in the NGSS 410. In the membrane system 700, a distribution manifold 702 distributes the purified air 608 among a series of membranes 704. The membranes 704 are selective to allow the other gases 612 to flow across the surface of the membranes 704, while limiting the flow of nitrogen across the surface. This generates the nitrogen enhanced stream 614 that may be used as the pressure maintenance gas in the APMS.

A collection manifold 706 may collect the nitrogen enhanced stream 614 from the membranes 704. The nitrogen enhanced stream 614 from the membranes 704 may include about 95% nitrogen, which may be sufficient for many APMS applications. Lower flow rates may be used to generate higher nitrogen concentrations but may provide more limited amounts of the nitrogen enhanced stream 614. Higher nitrogen concentrations may be achieved using other technologies, such as the pressure swing adsorption system described with respect to FIG. 8, or other technologies such as cryogenic separations. However, these technologies may add extra cost to the system.

Figure 8:
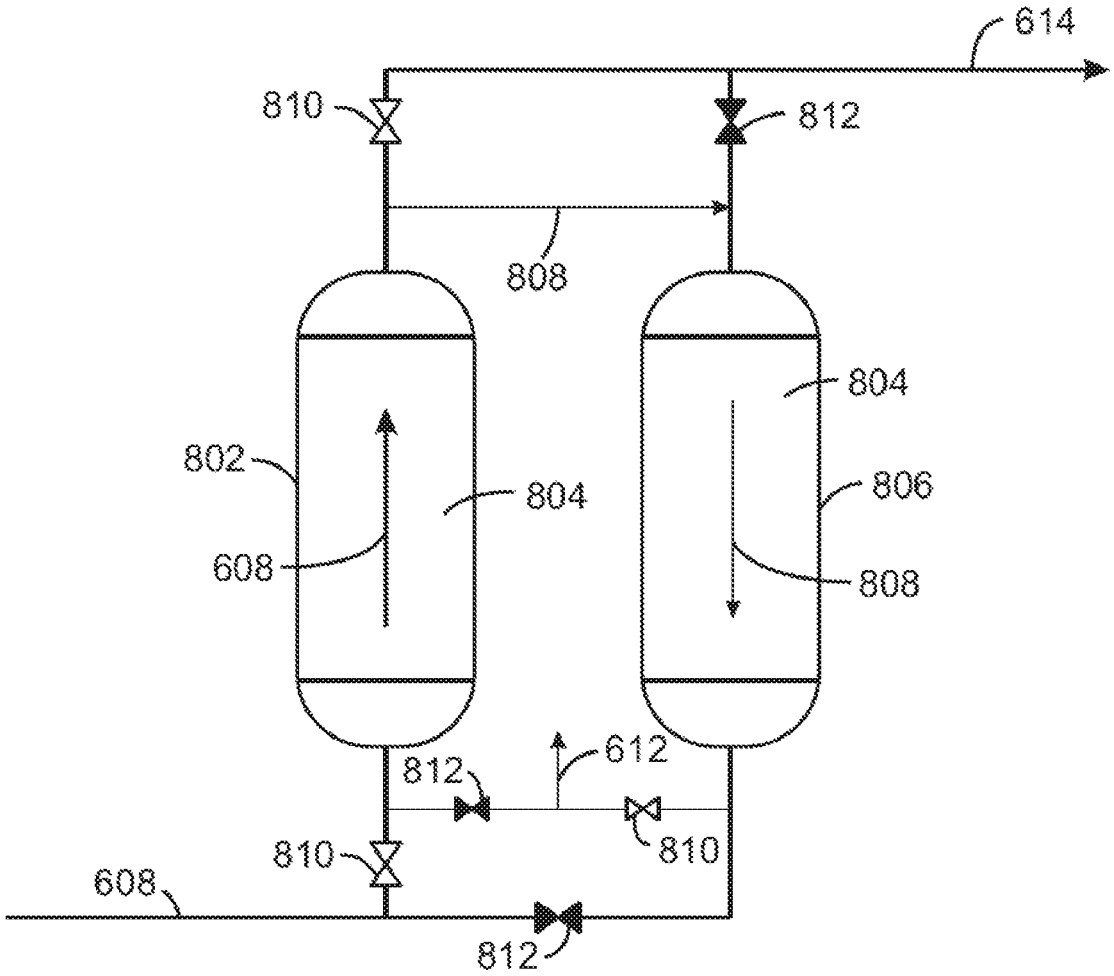
FIG. 8 is a schematic diagram of an example of a pressure swing absorption (PSA) system for generating a nitrogen enhanced stream in the NGSS.

FIG. 8 is a schematic diagram of an example of a pressure swing adsorption (PSA) system 800 for generating a nitrogen enhanced stream 614 in the NGSS 410. Like numbered items are as described with respect to FIGS. 4 and 6. The PSA system 800 includes a first adsorption unit 802 that supports an adsorbent 804 that preferentially absorbs nitrogen contaminants, such as oxygen, carbon dioxide, and water vapor, among others. These contaminants are removed from the purified air 608 as it flows through the first adsorption unit 802, providing the nitrogen enhanced stream 614.

While the adsorbent 804 in the first adsorption unit 802 is creating the nitrogen enhanced stream 614, adsorbent 804 in a second adsorption unit 806 is regenerated. This is performed by taking a portion 808 of the nitrogen enhanced stream 614 and passing it through the adsorbent 804 in the second adsorption unit 806 to desorb the other gases 612 from the adsorbent 804 in the second adsorption unit 806.

Once the adsorbent 804 in the first adsorption unit 802 is spent, the second adsorption unit 806 will be placed online by closing the open valves 810 an opening the closed valves 812. The second adsorption unit 806 will then generate the nitrogen enhanced stream 614 while the first adsorption unit 802 is regenerated. The two adsorption units 802 and 806 may be cycled about every two to ten minutes, depending on size and desired nitrogen purity.

The PSA system 800 may provide a higher concentration of nitrogen in the nitrogen enhanced stream 614 than the membrane system 700 described with respect to FIG. 7. For example, the nitrogen enhanced stream 614 from the PSA system 800 may include up to about 99.9995% nitrogen. The PSA system 800 may be operated less efficiently if a lower quality of nitrogen, such as about 95% nitrogen, 99% nitrogen, or higher, is acceptable. However, the cost of operating the PSA system 800 may be higher than the membrane system 700. Accordingly, if a lower nitrogen concentration in the nitrogen enhanced stream 614 is acceptable, the membrane system 700 may be selected.

Figure 9:
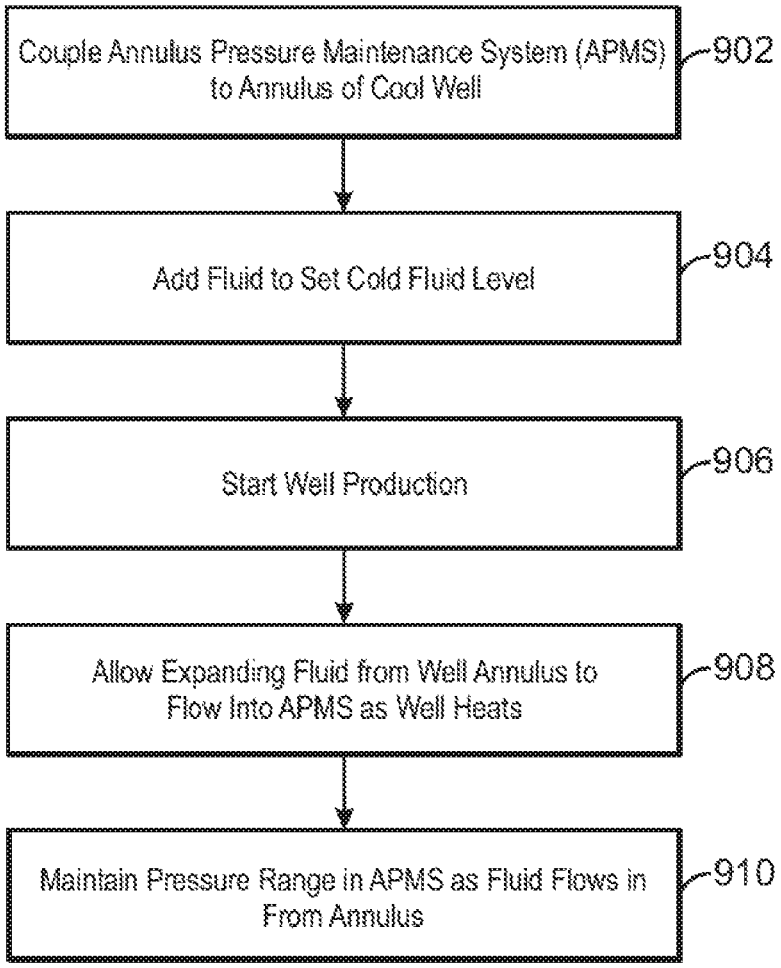
FIG. 9 is a process flow diagram of an example of a method for using an APMS to maintain the pressure of a fluid in an annulus of a well.

FIG. 9 is a process flow diagram of an example of a method 900 for using an APMS to maintain the pressure of a fluid in an annulus of a well. The method may begin at block 902 when the APMS is coupled to the annulus of a cold well, for example, which is blocked in. At block 904, fluid may be added to the APMS to set a cold fluid level in an accumulator.

At block 906, well production may be started. As described herein, geothermal gradients may result in heating the production line and, thus, the annuli, resulting in an expansion of fluid in an annulus.

At block 908, the expanding fluid from the annulus may flow into the APMS, for example, into a passive accumulator. At block 910, the pressure range for a pressure set point may be maintained as the fluid flows in from the annulus. This may be performed by venting portion of gas from a headspace over the fluid, such as to a flare through a knockout pot. As described herein, if the well is blocked in and allowed to cool, fluid from the APMS may be allowed to return to the annulus as the fluid in the annulus contracts. The pressure is maintained in the set point range during this process.

Figure 10:
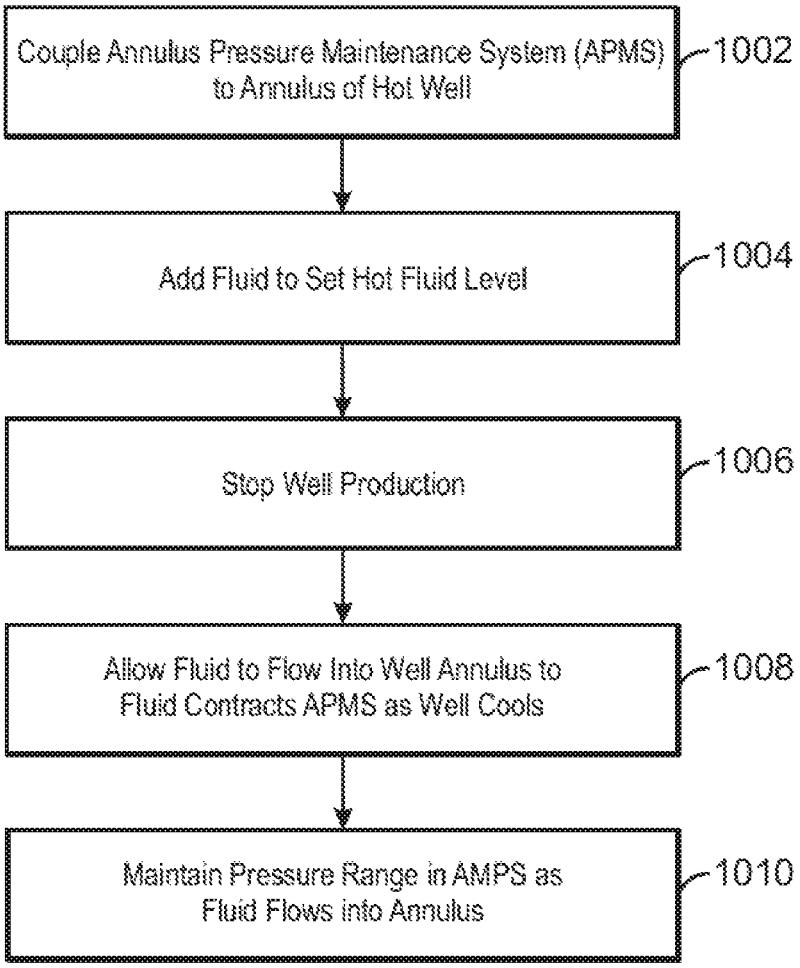
FIG. 10 is a process flow diagram of an example of a method for using a pressure maintenance system to add fluid to an annulus of a well during a shutdown procedure, while maintaining pressure on the annulus.

FIG. 10 is a process flow diagram of an example of a method 1000 for using a pressure maintenance system to add fluid to an annulus of a well during a shutdown procedure, while maintaining pressure on the annulus. The method 1000 may begin at block 1002, when an APMS is coupled to the annulus of a hot well, for example, which is in production. At block 1004, fluid may be added to the APMS to set a hot fluid level in a passive accumulator. Once the fluid is added, the APMS may be opened to the annulus.

At block 1006, production may be stopped from the well, for example, by blocking in the well. This may allow the well and the surrounding annuli to cool. This may allow fluid in the annulus to contract, lowering the pressure in the annulus.

At block 1008, fluid may be allowed to flow into the well annulus from the APMS as the fluid in the annulus contracts. At block 1010, a pressure range, around a set point is maintained in the APMS as fluid flows into the annulus, for example, by the addition of gas to the headspace of a passive accumulator.

Figure 11:
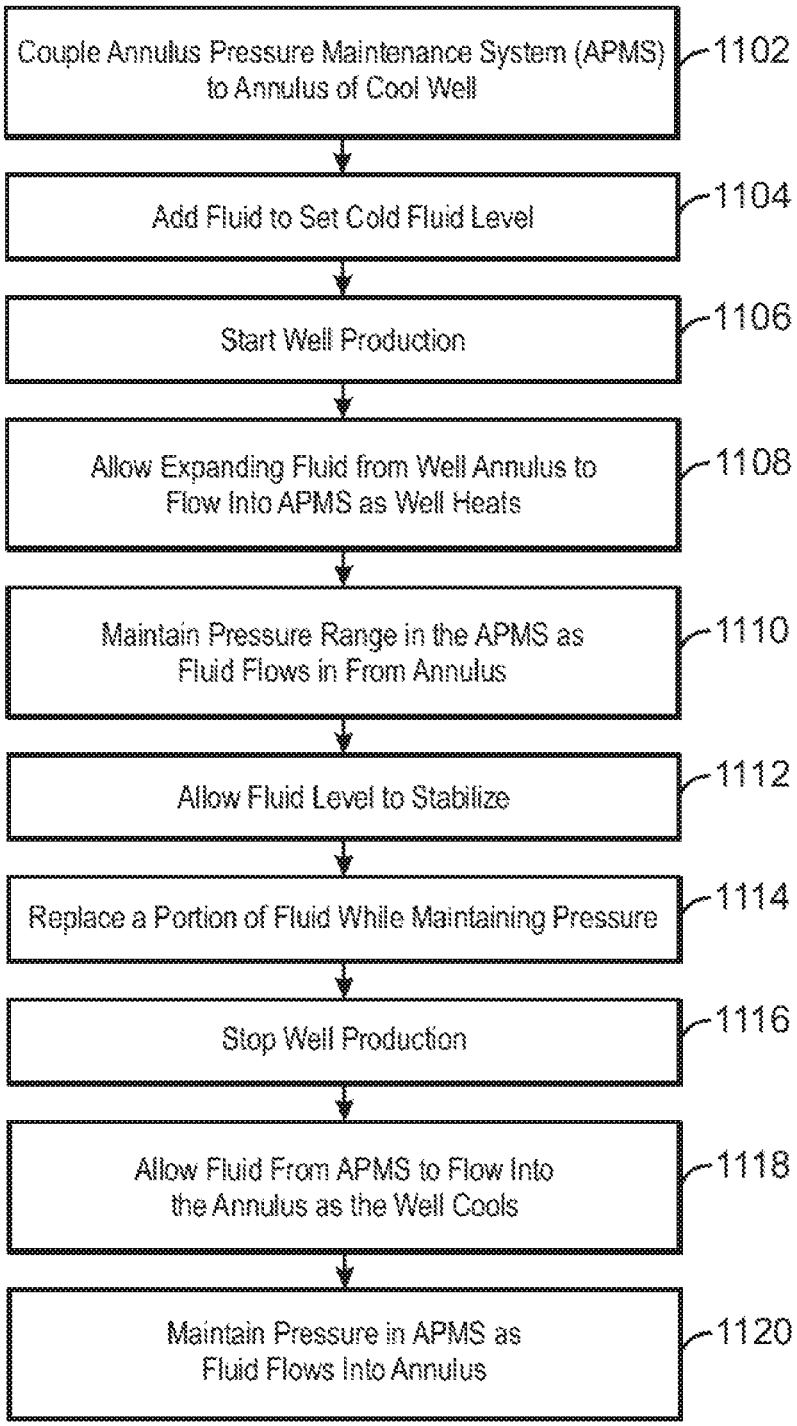
FIG. 11 is a process flow diagram of an example of a method for using in APMS to replace fluid in an annulus of a well by a sequential startup and shutdown procedure.

In addition to the basic pressure maintenance operations described with respect to FIGS. 10 and 11, the APMS may be used to replace fluid in a well annulus. This may be performed to increase the density of the fluid in the annulus, or the concentration of additives in the fluid, such as shale stabilizers, among others. Replacing the fluid in the well annulus may also be used to lower moisture content in the fluid, or remove other contaminants that may have built up in the fluid.

FIG. 11 is a process flow diagram of an example of a method 1100 for using an APMS to replace fluid in an annulus of a well by a sequential startup and shutdown procedure. The method may begin at block 1102, when an APMS is coupled to an annulus of a cold well. At block 1104, fluid may be added to the APMS to set a cold fluid level.

At block 1106, well production may be started. As hydrocarbons flow up a production line from a reservoir, the well and the annulus may by heated. At block 1108 expanding fluid from the well annulus flows into the APMS as the well heats. At block 1110 the pressure range around the pressure set point in the APMS is maintained as the fluid level increases. At block 1112, the fluid level is allowed to stabilize, for example, indicating that the heating of the annulus has reached an equilibrium temperature.

At block 1114, a portion of the fluid in the APMS may be replaced while maintaining the pressure set point, for example, by the addition and venting of gas from a headspace over the fluid in a passive accumulator. At block 1116, well production may be stopped to allow the well and the annulus to cool.

At block 1118, fluid from the APMS flows into the annulus as the well cools, replacing contracting fluid in the annulus. At block 1120 the pressure set point is maintained in the APMS as fluid flows into the annulus, for example, by the addition of gas to a headspace over the fluid in a passive accumulator.

While the present techniques may be susceptible to various modifications and alternative forms, the embodiments discussed above have been shown only by way of example. However, it should again be understood that the techniques is not intended to be limited to the particular embodiments disclosed herein. Indeed, the present techniques include all alternatives, modifications, and equivalents falling within the true spirit and scope of the appended claims.

What is claimed is:

1. A pressure maintenance system for an annulus of a well, comprising:

a passive accumulator coupled to the annulus to accept fluid expanding in the annulus or to supply fluid to replace fluid contracting in the annulus;

a gas pressure system to maintain a gas in a headspace over the fluid in the passive accumulator;

a pressure controller to maintain pressure in the headspace within a set range a production valve to block a flow of a production fluid from the well in response to fluid expanding in the annulus: and a production valve controller to maintain the blocked flow of production from the well while the accepted fluid in the passive accumulator passively flows back into the annulus as the well cools.

2. The pressure maintenance system of claim 1, wherein the passive accumulator comprises a group of interconnected vessels.

3. The pressure maintenance system of claim 1, wherein the gas pressure system comprises a nitrogen plant.

4. The pressure maintenance system of claim 3, where the nitrogen plant comprises a nitrogen membrane system.

5. The pressure maintenance system of claim 3, wherein the nitrogen plant comprises a pressure swing adsorption system.

6. The pressure maintenance system of claim 1, wherein the gas pressure system comprises gas storage tanks.

7. The pressure maintenance system of claim 1, wherein the pressure controller comprises a gas feed valve coupled to a gas storage system.

8. The pressure maintenance system of claim 1, wherein the pressure controller comprises a vent valve coupled to the headspace of the passive accumulator.

9. The pressure maintenance system of claim 1, wherein the pressure controller comprises a pressure sensor to monitor the pressure in the headspace.

10. The pressure maintenance system of claim 1, comprising a level indicator on the passive accumulator.

11. The pressure maintenance system of claim 1, comprising a liquid addition system to add liquid to the passive accumulator.

12. A method for maintaining a pressure on an annulus of a well, comprising:

coupling a passive accumulator in a pressure maintenance system to the annulus of the well while the well is blocked in and cool;

adding a fluid to the passive accumulator to set a cold fluid level;

starting production from a production line in the well;

allowing expanding fluid from the annulus to flow into the passive accumulator as the well heats;

maintaining a pressure set point in the passive accumulator;

blocking in the production line:

allowing fluid from the passive accumulator to flow into the annulus as the well cools: and maintaining the pressure set point in the passive accumulator.

13. The method of claim 12, wherein maintaining the pressure set point in the passive accumulator comprises venting gas from the passive accumulator as the fluid level increases in the passive accumulator.

14. The method of claim 12, wherein maintaining the pressure set point in the passive accumulator comprises adding gas to the passive accumulator as the fluid level decreases in the passive accumulator.

15. The method of claim 12, comprising:

waiting until a fluid level in the passive accumulator stabilizes at a hot fluid level; and replacing a portion of the fluid with a fresh fluid.

16. The method of claim 15, comprising blocking in the well to allow the annulus to cool and the fresh fluid to flow into the annulus.

17. The method of claim 12, comprising producing a gas for pressure maintenance at a well site.

18. The method of claim 17, comprising operating a nitrogen plant to produce the gas for pressure maintenance.

19. A method for maintaining a pressure on an annulus of a well, comprising:

coupling a passive accumulator in a pressure maintenance system to the annulus of the well while the well is in production and hot;

adding a fluid to the passive accumulator to set a hot level;

stopping production from a production line in the well;

allowing fluid from the passive accumulator to flow into the annulus as the well cools; and maintaining a pressure set point in the passive accumulator.

20. The method of claim 19, comprising:

starting production from the well;

allowing fluid from the annulus to flow into the passive accumulator as the well heats; and maintaining the pressure set point in the passive accumulator.

21. A method for replacing a fluid in an annulus of a well, comprising:

coupling a passive accumulator in a pressure maintenance system to the annulus while the well is cool;

adding fluid to the passive accumulator to set a cold fluid level;

starting well production;

allowing expanding fluid from the annulus to flow into the passive accumulator as the well heats;

allowing a fluid level to stabilize in the passive accumulator;

replacing a portion of the fluid in the passive accumulator;

stopping the well production and allowing the well to cool; and allowing contracting fluid in the annulus to pull fluid from the passive accumulator as the well cools.

22. The method of claim 21, comprising maintaining a pressure set point range on the passive accumulator as the fluid level changes.

23. The method of claim 21, comprising:

cycling a temperature on the well by starting and stopping production;

replacing a portion of the fluid in the passive accumulator after the level stabilizes at each high point; and maintaining the pressure set point range on the passive accumulator through a procedure.

24. The method of claim 21, comprising incorporating additives into the fluid that is used to replace fluid in the passive accumulator.

* * * * *